United States Patent [19]

Hebert et al.

[11] Patent Number: 4,907,953

[45] Date of Patent: Mar. 13, 1990

[54] LOCKING GAS EQUALIZER ASSEMBLY

[76] Inventors: Douglas W. Hebert, P.O. Box 2335; Elgie Harris, II, P.O. Box 185, both of Farmington, N. Mex. 87499

[21] Appl. No.: 249,582

[22] Filed: Sep. 26, 1988

[51] Int. Cl.[4] ..... F04B 7/00; F04B 21/04

[52] U.S. Cl. ..... 417/444

[58] Field of Search ..... 417/451–453, 417/443–447, 448, 449, 450

[56] References Cited

U.S. PATENT DOCUMENTS

| | | | |
|---|---|---|---|
| 1,409,450 | 3/1922 | Langley | 417/452 |
| 2,286,550 | 6/1942 | Kelly et al. | 417/453 |
| 4,781,547 | 11/1988 | Madden | 417/554 |

*Primary Examiner*—Leonard E. Smith

*Attorney, Agent, or Firm*—James E. Snead

[57] ABSTRACT

A locking gas equalizer is provided for use with a subsurface pump for lifting fluids having a high gas content. A mechanical lifting piston and rod are slidably mounted beneath the check valve in the traveling pump assembly. When the pump reaches the bottom of its down stroke the piston raises the rod and unseats the check valve. As the pump cycle reverses at the top of the stroke, the inertia of the piston also causes the rod to be raised for unseating the check valve and allowing a small amount of fluid to drop into the pump chamber. Thus, gas pressure within the pump chamber volumes is positively equalized to prevent gas lock up of the pumping action. A hexagonal alignment slider maintains alignment of the lifting piston to prevent hangup of the piston in a stroke through pump. The hexagon and a locking slot in the piston also prevent relative rotation of the equalizer assembly components to enable the pump sucker rod to be rotated for removal from the pump assembly in tubing pumps requiring on and off tool. The downhole disassembly permits the gas equalizer assembly to be used with large bore pumps for increased pumping volume.

24 Claims, 4 Drawing Sheets

LOCKING GAS EQUALIZER ASSEMBLY

BACKGROUND OR INVENTION

This invention relates to subsurface pumps for pumping fluids from boreholes and, more particularly, to pumps for pumping fluids with a high gas content from boreholes.

A subsurface pump is a positive displacement type pump. It consists of a cylindrical barrel in which a hollow plunger, standing valve (inlet), and traveling valve (exhaust) act to raise the fluid from below ground to the surface. The force necessary to move the plunger within the barrel is transferred from the surface pumping unit through a string of sucker rods to the pump which is set at a predetermined location in the hole. At the end of a down stroke of the pump both valves are closed. On the up stroke, the weight of the fluid in the plunger annulus keeps the traveling valve closed. Differential pressure created by the upward movement of the closely fitted plunger and the pressure of the fluid below the ball forces the standing valve open. This allows fluid to flow into the space in the barrel previously occupied by the plunger. On the down stroke, the ball drops into place to close the standing valve. As the hollow plunger passes through the fluid trapped in the barrel, the pressures above and below the plunger are equalized. At this point, assuming that the barrel contains non-compressible liquid rather than compressible gas, the traveling valve is forced open. On the other hand, if the barrel contains primarily gas, the gas compresses and does not develop sufficient force to open the traveling valve. Upon opening of the traveling valve, the fluid flows through the open-top traveling valve cage into the upper part of the barrel and into the tubing. On subsequent up strokes, the fluid column is displaced into the tubing. Each stroke raises the fluid level in the tubing. On further down strokes, more fluid is forced through the plunger into the barrel and tubing. Eventually the fluid in the well is displaced at the surface. However, in gaseous wells, the chambers of a tubing pump will not allow sufficient compression to control gas-related problems and heretofore tubing pumps have not been recommended for medium to extreme gaseous wells.

Pumps are conventionally placed down boreholes to pump fluids, such as water or oil, from boreholes. A typical pump may comprise at least two check valves: a standing ball and seat check valve for admitting fluid above the standing valve and checking the flow of fluid beneath the valve, and a traveling ball and seat check valve for admitting fluid above the valve during a down stroke of the pump and checking the fluid flow during an up stroke of the pump. During the up stroke, a reduced pressure is created above the standing valve to cause the valve to open, admitting fluid above the standing valve and below the traveling valve. During the down stroke, the standing valve closes and fluid pressure beneath the traveling valve normally forces the traveling valve to open so that fluid flows through the traveling valve into the upper pump chamber during the down stroke.

There are, however, many wells which produce fluids having a high gas content. The pumping efficiency of conventional pumps, as hereinabove discussed, is considerably reduced, and pumping action can be completely blocked. While a liquid is substantially incompressible, hydraulically opening the check valves during the reciprocating pump stroke, a gas is compressible. Thus, gas located between the traveling check valve and the standing check valve can merely compress during the down stroke without generating sufficient pressure to open the traveling valve. No liquid is then admitted above the valve to be lifted during the up stroke and the pump is gas locked. This problem is aggravated in large bore pumps, where considerably more internal volume is available for gas accumulation, with concomitant low pressurization during compression.

There have been attempts to alleviate the problem of gas locking. U.S. Pat. No. 3,941,516, issued Mar. 2, 1976, to Soberg, provides a head valve above the traveling valve to relieve pressure above the traveling valve during the down stroke to minimize the pressure needed to unseat the valve. U.S. Pat. No. 4,557,668, issued Dec. 10, to Jones, also includes a head valve (gas release valve therein). Jones further includes a trip to release the head valve at the upper end of the stroke to release fluid being carried upward by the traveling valve.

Each of the above pumps requires differential pressure to unseat the traveling check valve, and therefore that pressure equalization and gas release is not assured. Also, the pumps can act to remove all liquids from above the standing valve and there is no remaining fluid for the equalizer to unseat the traveling valve at the lowest part of the down stroke. Further, none of the above pumps would be suitable for use as an enlarged bore pump since the traveling valve assemblies are rotatable within the traveling cage and the sucker rod cannot be disengaged.

A stroke-through pump presents a particular problem for an equalizing assembly. In such a pump the traveling valve and equalizer assembly pass from a relatively large diameter portion of the pump barrel into a relatively smaller diameter portion of the pump barrel having a close tolerance between the inside diameter of the pump barrel and outside diameter of the pump plunger and equalizer assembly. Such a transition is necessary in a stroke-through pump to clean particulate matter from the pump on the upstroke. However, the traveling valve and equalizer assembly must remain in alignment and have sufficient lateral stability to prevent the equalizer assembly from hanging up on that portion of the barrel where it reduces in diameter. Absent such alignment and stability, the equalizer assembly is likely to be damaged or snapped off on the upstroke.

These problems, and others, are addressed by the present invention, wherein a pressure equalizer assembly is provided for positively unseating a traveling check valve at end portions of the reciprocating stroke while enabling the check valve to seat normally for fluid pumping.

Accordingly, it is an object of the present invention to provide for mechanically unseating the traveling check valve at a location nearest the standing check valve.

It is another object of the present invention to provide a traveling check valve unseating mechanism for reciprocating with the traveling valve that maintains its alignment relative to the pump and is locked against rotation relative to the traveling valve cage.

Still another object is to enable some liquid to escape from the pump chamber downwardly through the traveling check valve cage to provide a non-compressible fluid at the bottom of the down stroke to activate the equalizing device.

Another object is to enable the pump to be separated from the sucker rods in the borehole or larger-oversized pumps when the pump plunger diameter is larger than the tubing diameter.

Additional objects, advantages and novel features of the invention will be set forth in part in the description which follows, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF INVENTION

To achieve the foregoing and other objects, and in accordance with the purpose of the present invention, as embodied and broadly described herein, the apparatus of this invention may comprise a subsurface pump having a reciprocating stroke and including a standing check valve disposed in a standing valve cage and a traveling valve disposed in a traveling valve cage located above the standing valve cage. According to the present invention, a gas equalizer, comprising an unseating means, is slidably disposed between the standing valve and the traveling valve for unseating the traveling valve when the traveling valve cage is on the down stroke of the traveling value.

In another characterization of the present invention, a gas equalizer is provided for use in a subsurface pump with a standing valve in a standing cage and a traveling valve in a traveling valve cage. An unseating means is provided for traveling with the traveling valve cage and is effective to mechanically unseat the traveling check valve on the down stroke portion of the traveling valve cage and at a down stroke reversal of the reciprocating pump.

In one other characterization of the present invention, a method is provided for pumping fluid with a high gas content with a standing ball and seat check valve in a standing cage and a traveling ball and seat check valve in a traveling valve cage. The traveling check valve is mechanically unseated when the traveling cage is at the bottom of the down stroke to assure that any gas pressure beneath the traveling valve is released before the pumping stroke begins.

BRIEF DESCRIPTION OF THE DRAWINGS

The accompanying drawings, which are incorporated in and forms a part of the specification, illustrate embodiments of the present invention and, together with the description, serve to explain the principles of the invention. In the drawings.

DETAILED DESCRIPTION OF A PREFERRED EMBODIMENT

Figure 1:
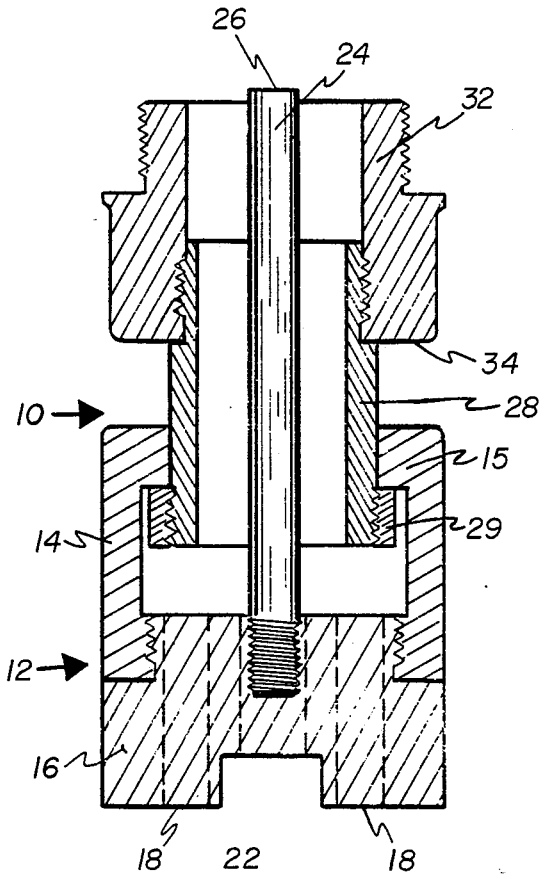
FIG. 1 is a cross sectional representation of a gas equalizer according to one embodiment of the present invention.

Referring now to FIG. 1, there is shown, in cross section, a gas equalizer assembly 10 in accordance with one embodiment of the present invention. A piston assembly 12 is slidably mounted for axial movement of unseating rod 24 within equalizer assembly 10. One end of rod 24 is preferrably concave 26 for mating with a check valve ball (not shown) and the other end threadingly engages piston 16, which moves rod 24.

Piston assembly 12 includes piston stop 14, piston 16 and rod 24. Piston 16 defines flow ports 18 for fluid movement through piston 16, and further defines anti-rotation slot 22 which acts with hexagonal slider member 28 to prevent rotation of equalizer 10 within a pump assembly, as discussed below. Piston stop 14 threadingly engages piston 16 and has a lip portion 15 for slidably engaging slider 28. Piston stop 14 is keyed with slider 28 to prevent any relative rotation between piston assembly 12 and slider 28. In a preferred embodiment, lip 15 defines an internal hexagon which engages an external hexagonal surface on slider 28 to prevent relative rotation between piston assembly 12 and slider 28 and to maintain the lateral stability of piston assembly 12 during axial movement.

Equalizer assembly 10 further includes top stop connector 32, which threadingly engages slider 28. Connector 32 defines up travel stop surface 34 to limit the upward travel of piston assembly 12. A down travel stop 29 threadingly mates with slider 28. In a preferred embodiment, surface 34 and down stop 29 permit piston assembly 12 to have an axial travel of about 0.4 inches. Connector 32 is generally provided with upper body threads to connect with a conventional traveling valve cage (not shown).

In operation, piston 16 moves upwardly to raise rod 24 for unseating the ball in the traveling check valve and downwardly to permit the traveling check valve to close, as hereinafter discussed. Piston assembly 12 has sufficient inertia to continue upward travel when an attached traveling valve cage is downwardly reciprocated, raising rod 24 for unseating the traveling check valve at the highest point in the valve stroke to allow fluid to drop into a lower chamber beneath piston 16. Piston 16 provides an enlarged pressure force area and contacts the fluid on top of the standing valve cage at the lowest point in the pump stroke to again raise rod 24 for mechanically unseating the traveling check valve at the lowest point. As hereinafter discussed, this mechanical unseating of the traveling check valve provides for gas pressure equalization within a subsurface pump for pumping a fluid with a high gas content. Hexagonal slider 28 keeps the equalizer in alignment to prevent damage when the assembly passive into the pump barrel in a stroke-through pump.

Figure 2:
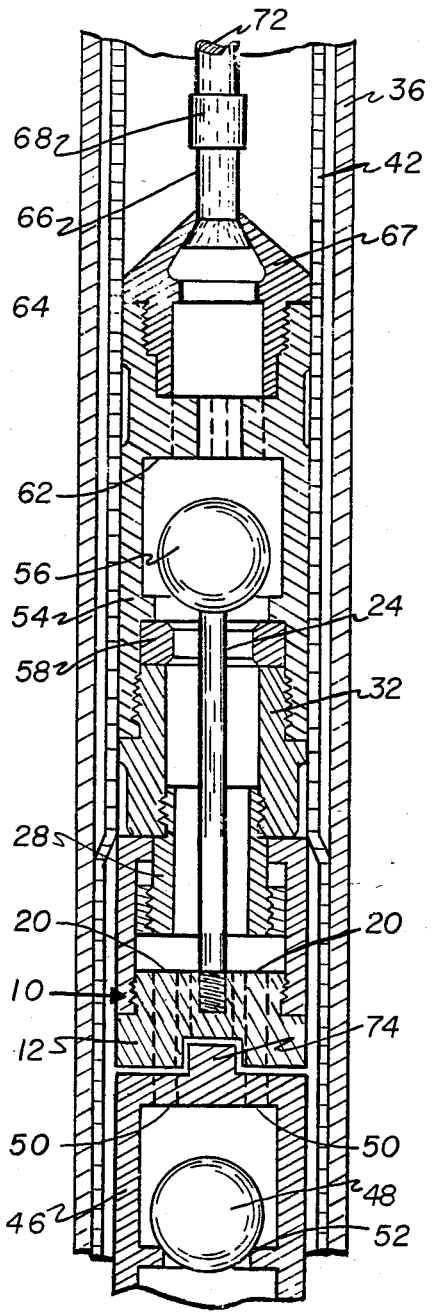
FIG. 2 is a pump assembly in partial cross section incorporating the gas equalizer shown in FIG. 1, wherein the pump traveling valve cage is at the bottom of the down stroke.

Referring now to FIG. 2, a subsurface pump assembly is depicted in partial cross section. In a conventional borehole, casing 36 may be run into the hole adjacent the well's natural formation and a production tubing string (not shown) is inserted within casing 36 and connected with pump barrel 42 of a subsurface tubing pump. In the embodiment shown in FIG. 2, pump barrel 42 has an enlarged diameter over the production tubing to permit a larger diameter (large bore) pump to be used for increased fluid flow. Reciprocating pumping action within pump barrel 42 is provided through sucker rods 72, which are connected with connecting rod 66 through a standard "on-off" tool 68.

The pump assembly shown in FIG. 2 includes a standing valve cage 46 and a traveling valve cage 54 above standing valve cage 46. Standing check valve 48 is preferably a ball and seat type valve with ball 48 sealing against seat 52. Fluid enters the pump through the standing valve and exists standing valve cage 46 through ports 50. Gas equalizer assembly 10 travels above standing valve cage 46 and is threadably connected with traveling valve cage 54.

Traveling valve cage 54, check valve 56, which is preferrably a ball and seat valve having ball 56 sealing against seat 58, and an upper ball stop 62. Fluid exits traveling cage 54 through upper ports 64 during the down stroke of the pump. Adapter 67 connects traveling valve cage 54 to connecting rod 66. Adapter 67 includes flow ports or other openings therein (not shown) for upward fluid movement within tubing 38.

FIG. 2 shows the pump at the bottom of the down stroke with the traveling valve cage at a point nearest the standing valve cage. In that position piston assembly 12 is urged upwardly against top stop connector 32 by incompressible fluid between piston 12 and standing valve cage 46. Unseating rod 24 is, accordingly, at an upward position to unseat ball 56 from seat 58. This mechanical unseating of ball 5 assures that gas pressures within traveling valve cage 54 and above standing valve cage 46 are equalized and that the fluid pressure below standing ball and seat valve 48 can unseat ball 48 for upward fluid flow into traveling valve cage 54.

Figure 3:
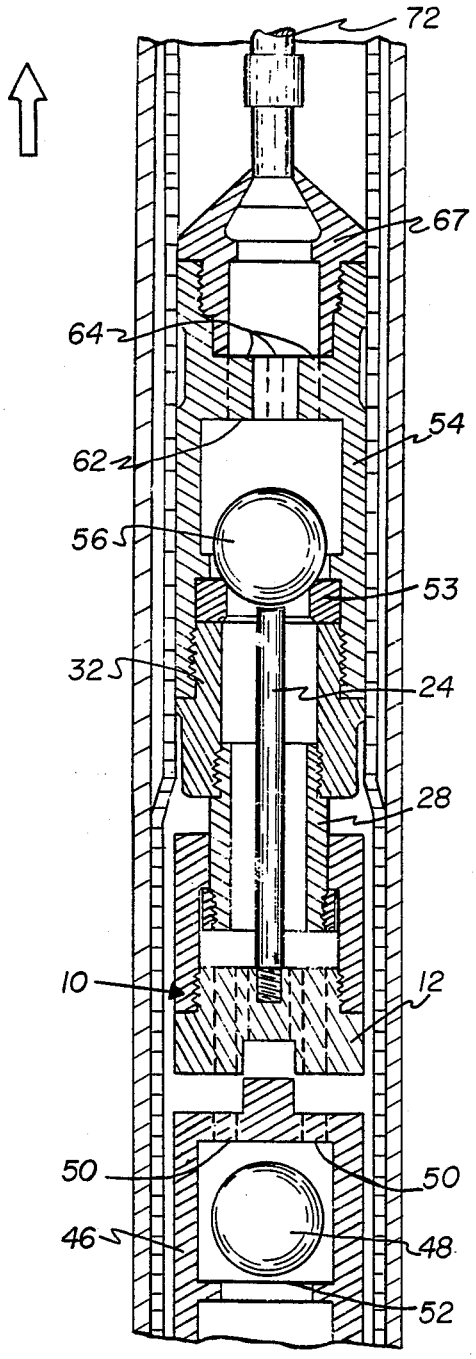
FIG. 3 is the pump assembly of FIG. 2, wherein the pump is on a upward stroke.

When the pump assembly begins an upward stroke, FIG. 3, piston assembly 12 slides down slider 28 to contact bottom stop 29, lowering rod 24 and permitting ball 56 to seal on seat 58. Fluid above ball 56 is now raised, and a reduced pressure is created below ball 56. Standing valve ball 48 opens with concomitant fluid flow into volume 76 below equalizer assembly 10 in a conventional manner.

Figure 4:
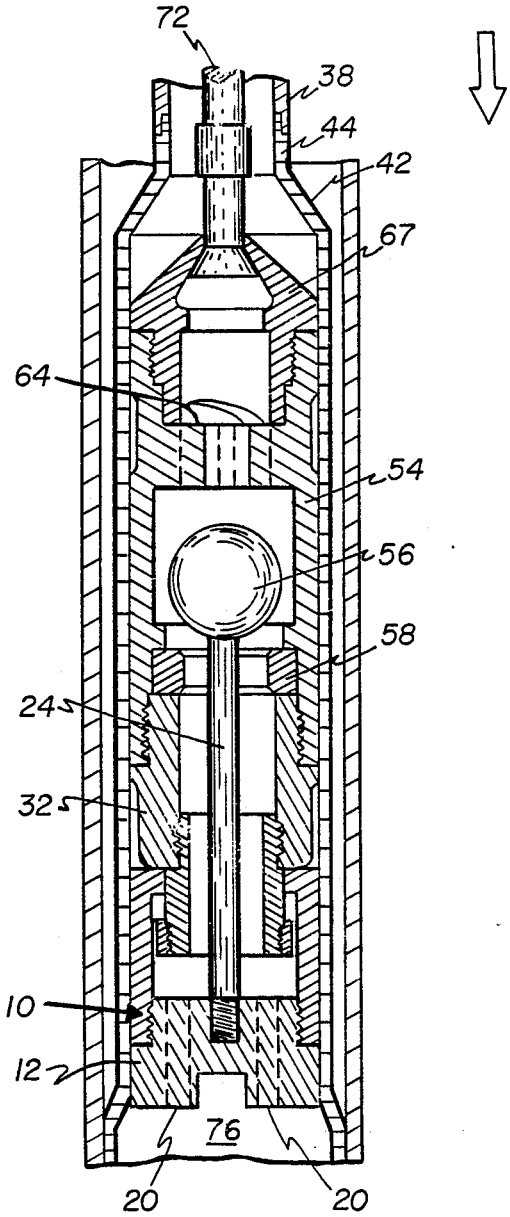
FIG. 4 is the pump assembly of FIG. 2, wherein the pump has reciprocated to a downward stroke.

At the top of the pump stroke, adapter 67 is raised to the top of pump barrel 42, adjacent the connection 44 with tubing 38 and the pump reciprocates downwardly, FIG. 4. However, the inertia of piston assembly 12 and the various viscous forces acting on piston 16 (FIG. 1) result in an initial upward movement of piston assembly 12 relative to traveling valve cage 54. Thus, rod 24 is raised relative to valve seat 58, and ball 56 is at least momentarily unseated when traveling cage 54 is furtherest from standing cage 46. Accordingly, a small amount of non-compressible fluid in the pump above ball 56 is enabled to drop back to the top of the standing valve cage to activate the piston 12 at the bottom of the down stroke. Piston assembly 12 thus acts to mechanically unseat ball 56 at the top of the stroke as well as the bottom of the stroke. The relatively large area of piston 16 compared to travelling valve ball 56 also allows a relatively low pressure in volume 76 to move piston assembly 12 during the down stroke to raise rod 24 and unseat ball 56.

Accordingly, it will be appreciated from the pump action described with reference to FIGS. 2–4 that the gas equalizer depicted in FIG. 1 enables a fluid with a high gas content to be pumped from a borehole. At the bottom of the pump stroke, piston assembly 12 is forced by contact with fluid above standing valve cage 46 to raise rod 24 into mechanical contact with ball 56 to unseat ball 56 if sufficient hydraulic pressure is not developed during compression of the fluid in volume 76 to raise piston assembly 12 and/or ball 56. This mechanical unseating action ensures that gas pressure is equalized about ball 56 and above standing ball 48 so that ball 48 can unseat to allow fluid to enter traveling valve cage 54 to be lifted during the upward pump stroke.

At the top of the pump stroke, the stroke is reciprocated to a downward travel and piston assembly 12 continues an upward motion to again urge rod 24 against ball 56 to unseat ball 56. Some of the fluid above ball 56 is allowed to flow back above standing valve cage 46 to again activate piston 12 at the bottom of the stroke. If sufficient liquid is present in volume 76, ball 56 will remain open to enable liquid to pass above ball 56 on the down stroke. If insufficient liquid is present, ball 56 may be closed by the hydrostatic pressure above ball 56, but ball 56 will again be lifted by rod 24 at the bottom of the stroke.

Another feature of equalizer assembly is illustrated by FIG. 2. In the down position, locking slot 22 engages key 74 to prevent any rotation of traveling valve cage 54 and equalizer assembly 10 with respect to standing valve cage 46. Further, piston stop 14 (FIG. 1) is keyed to slider 28 to prevent rotation of piston assembly 12 with respect to top stop connector 32 and to keep piston assembly 12 in alignment relative to pump barrel 42. Thus, "on-off" 68 tool can be rotated to disengage sucker rods 72 from the pump assembly and sucker rods 72 can be removed from the borehole with the pump assembly remaining within the borehole.

FIG. 3 illustrates yet another feature of equalizer valve assembly 10 according to the present invention. Enlarged Section 78 of pump barrel 42 is provided to accomodate particulate in fluid from standing valve cage 46. To prevent build up of particulate matter on the pump assembly and equalizer 12, the equalizer valve assembly axially traverses the region from below enlargement 78 to above the transition. Equalizer assembly 10 must provide sufficient alignment and lateral stability to maintain piston assembly 12 concentric with the pump barrel above enlargement 78 to prevent hangup of and damage to piston assembly 12 at the transition. By way of example, a 0.250 inch clearance may exist below enlargement 78 and only a b 0.002 inch clearance above enlargement 78.

The sliding assembly of equalizer 10 provides the required stability. A hexagonal shape is provided for slider 28 and piston stop 14 (FIG. 1) so that both the anti-rotation and lateral stability functions are obtained. The hexagonal surfaces enable close tolerances to be maintained while permitting free axial travel of piston assembly 12.

The anti-rotation alignment and locking features in the present invention thus enable an enlarged diameter pump barrel 42 to be used to provide a large bore pump for increased fluid pumping and/or enable a stroke-through design to be used. The equalizer features in the prior art do not permit the pump to be disengaged from the sucker rods so that large bore pumps cannot be used without simultaneously pulling both the tubing and the sucker rods from the hole. Further, the equalizer assemblies do not have adequate lateral stability to be used with a stroke-through pump barrel.

It is apparent from the above description that the locking gas equalizer assembly according to the present invention provides positive equalization of pressures within the pump assembly to prevent gas locking of the pumping action. The alignment and rotation locking features provided herein also enable a large bore pump to be used with high gas content fluids. In conventional pumps, an enlarged diameter pump barrel only aggravates gas locking.

The foregoing description of a preferred embodiment of the invention has been presented for purposes of illustration and description. It is not intended to be exhaustive or to limit the invention to the precise form disclosed, and obviously many modifications and variations are possible in light of the above teachings. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claim appended hereto.

What is claimed is:

1. A method for pumping a fluid with a high gas content with a standing check valve in a standing cage and a traveling check valve in a traveling cage, comprising the steps of mechanically unseating said traveling check valve when said traveling cage is at a position nearest said standing cage;

mechanically unseating said traveling check valve momentarily as said traveling cage reverses direction at a location furtherest from said standing cage;

actuating a piston disposed between said traveling cage and said standing valve to axially reciprocate an unseating rod for engaging said traveling check valve; and locking said piston against rotation relative to said traveling cage.

2. A gas equalizer for use in a reciprocating subsurface pump having a standing check valve in a standing cage and a traveling check valve in a traveling cage, comprising:

unseating means effective to mechanically unseat said traveling valve when said traveling cage is in a position nearest said standing valve;

a sliding surface depending from said traveling valve; and piston means slidably attached to said sliding surface for reciprocating said unseating means within said traveling valve;

said sliding surface and said piston means defining at least two facing planar surfaces for lateral stability of said piston means effective for relative reciprocation of said piston means on said sliding surface in said traveling valve.

3. A gas equalizer according to claim 2, wherein said at least two planar surfaces are polygonal surfaces.

4. A gas equalizer for use in a reciprocating subsurface pump having a standing check valve in a standing cage and a traveling check valve in a traveling cage for reciprocation by sucker rods extending from a borehole, comprising:

unseating means effective to mechanically unseat said traveling valve when said traveling cage is in a position nearest said standing valve; and locking means for locking said gas equalizer against rotation relative to said traveling valve cage and said standing valve for rotatably removing said sucker rods from said traveling valve in said borehole.

5. A gas equalizer according to claim 4, wherein said unseating means has an inertia effective to unseat said traveling valve during at least a portion of a downward reversing portion of said reciprocating stroke.

6. A gas equalizer according to claims 4 or 5, wherein said unseating means comprises: a rod for contacting said traveling check valve in a first position and slidable to a second position; and a piston connected to said rod for slidably moving said rod.

7. A gas equalizer according to claim 6 further including slider means defining a hexagonal surface connected with said piston for axially reciprocating said piston relative to said standing cage and aligning said piston with said pump barrel.

8. A gas equalizer according to claim 6, wherein said traveling valve is a ball and seat valve.

9. A gas equalizer according to claim 6, wherein said piston includes ports for passing fluid from a first volume above said standing valve to a second volume within said traveling valve cage.

10. A gas equalizer according to claim 4, further including means to lock said equalizer against rotation relative to said standing valve cage.

11. A subsurface pump having a reciprocating stroke from an assembly of sucker rods extending from a borehole, comprising:

a standing check valve disposed in a standing valve cage;

a traveling check valve disposed in a traveling valve cage;

a gas equalizer, including unseating means slidably disposed between said standing valve and said traveling valve for mechanically unseating said traveling valve when said traveling valve cage is in a position nearest said standing valve cage; and locking means for locking said gas equalizer against rotation relative to said traveling valve cage and said standing valve for rotatably removing said sucker rods from said traveling valve in said borehole.

12. A pump according to claim 11, wherein said unseating means has an inertia effective to unseat said traveling valve during at least a portion of a downward reversing portion of said reciprocating stroke.

13. A pump according to claims 11 or 12 wherein said unseating means comprises: a rod for contacting said traveling check valve in a first position and slidable to a second position; and a piston connected to said rod for slidably moving said rod.

14. A pump according to claim 13, further including slider means defining a hexagonal surface connected with said piston for axially reciprocating said piston relative to said standing cage and aligning said piston within said pump barrel.

15. A pump according to claim 13, wherein said traveling valve is a ball and seat valve.

16. A pump according to claim 13, wherein said piston includes ports for passing fluid from a first volume above said standing valve to a second volume within said traveling valve cage.

17. A subsurface pump according to claim 16, wherein said unseating means includes a slide means fixed to said traveling valve; and piston means slidably attached to said slide means;

said slide means and said piston means having a mating relationship effective to prevent relative rotation therebetween.

18. A subsurface pump according to claim 17, wherein said mating relationship defines polygonal surfaces.

19. A subsurface pump according to claim 17, wherein said unseating means further includes a mating relationship between said unseating means and said standing check valve cage effective to prevent relative movement therebetween when said unseating means is lowered onto said standing check valve cage by said reciprocating sucker rods.

20. A subsurface pump according to claim 19, wherein said mating relationship is a tongue and groove.

21. A subsurface pump according to claim 1, wherein said unseating means includes a slide means fixed to said traveling valve; and piston means slidably attached to said slide means;

said slide means and said piston means having a mating relationship effective to prevent relative rotation therebetween.

22. A subsurface pump according to claim 21, wherein said mating relationship defines polygonal surfaces.

23. A subsurface pump according to claim 21, wherein said unseating means further includes a mating relationship between said unseating means and said standing check valve cage effective to prevent relative movement therebetween when said unseating means is lowered onto said standing check valve cage by said reciprocating sucker rods.

24. A subsurface pump according to claim 23, wherein said mating relationship is a tongue and groove.

* * * * *